US008531132B2

(12) United States Patent
Oh et al.

(10) Patent No.: US 8,531,132 B2
(45) Date of Patent: Sep. 10, 2013

(54) BACKLIGHT UNIT, DRIVING METHOD THEREOF, AND ERROR DETECTION METHOD THEREOF

(75) Inventors: Won-Sik Oh, Asan-si (KR); Youngsup Kwon, Gwangmyeong-si (KR); Min-Soo Choi, Asan-si (KR)

(73) Assignee: Samsung Display Co., Ltd., Yongin (KR)

( * ) Notice: Subject to any disclaimer, the term of this patent is extended or adjusted under 35 U.S.C. 154(b) by 318 days.

(21) Appl. No.: 12/902,731

(22) Filed: Oct. 12, 2010

(65) Prior Publication Data

US 2011/0175547 A1 Jul. 21, 2011

(30) Foreign Application Priority Data

Jan. 18, 2010 (KR) ..... 10-2010-0004445

(51) Int. Cl.
*H05B 37/02* (2006.01)

(52) U.S. Cl.
USPC ..... 315/307; 315/185 R; 315/192

(58) Field of Classification Search
USPC ..... 315/185 R, 186, 192, 291, 297, 299, 315/307, 308, 312; 345/102
See application file for complete search history.

(56) References Cited

U.S. PATENT DOCUMENTS

| | | | | |
|---|---|---|---|---|
| 2004/0208011 | A1* | 10/2004 | Horiuchi et al. | 362/458 |
| 2008/0290906 | A1* | 11/2008 | Chou et al. | 327/77 |
| 2009/0153066 | A1* | 6/2009 | Yang et al. | 315/192 |
| 2010/0194308 | A1* | 8/2010 | Zhao et al. | 315/297 |
| 2011/0018450 | A1* | 1/2011 | Hsu et al. | 315/185 R |

FOREIGN PATENT DOCUMENTS

| | | |
|---|---|---|
| JP | 2005-259724 | 9/2005 |
| KR | 1020090015609 | 2/2009 |
| KR | 1020090060878 | 6/2009 |

* cited by examiner

*Primary Examiner* — Tung X Le
(74) *Attorney, Agent, or Firm* — H.C. Park & Associates, PLC

(57) ABSTRACT

A backlight unit includes a driving circuit, a plurality of light source strings, and an error detector. The driving circuit outputs a driving voltage. Each of the light source strings includes a plurality of light sources and receives the driving voltage through input terminals of the light source strings to generate a light. The error detector is connected to output terminals of the light source strings and senses voltages between the input terminals and the output terminals of the light source strings to detect an error in the light sources using a first voltage and a second voltage. The first voltage is a voltage difference between a maximum and a minimum of the sensed voltages and the second voltage is obtained by dividing one sensed voltage of the sensed voltages by a number of the light sources of a light source string from which the one sensed voltage is sensed.

25 Claims, 3 Drawing Sheets

BACKLIGHT UNIT, DRIVING METHOD THEREOF, AND ERROR DETECTION METHOD THEREOF

CROSS-REFERENCE TO RELATED APPLICATION

This application claims priority to and benefit of Korean Patent Application No. 10-2010-0004445, filed on Jan. 18, 2010, which is herein incorporated by reference for all purposes as if fully set forth herein.

BACKGROUND OF THE INVENTION

1. Field of the Invention

Exemplary embodiments of the present invention relate to a backlight unit capable of improving error detection with respect to light sources thereof, and a method for driving the backlight unit and providing an error detection of the backlight unit.

2. Description of the Related Art

A liquid crystal display may include a liquid crystal display panel for displaying an image and a backlight unit of the liquid crystal display panel for providing light to the liquid crystal display panel. Recently, instead of using cold cathode fluorescent lamps, attention to light emitting diodes adopted as light sources of the backlight unit have been increased because the light emitting diodes have various advantages over the conventional fluorescent lamps such as low power consumption and high color reproducibility.

If light emitting diodes are adopted as the light sources of the backlight unit, the backlight unit may include a plurality of light source strings connected to each other in parallel and each of the light source strings may include a plurality of light emitting diodes connected to each other in series. As a consequence, the light emitting diodes of the light source strings may encounter a problem that may cause a short circuit or an open circuit. Thus, there is a need for an approach to provide an error detection scheme for a circuit condition.

SUMMARY OF THE INVENTION

Exemplary embodiments of the present invention provide a backlight unit capable of improving error detection with respect to light sources employed therein.

Exemplary embodiments of the present invention provide a method for driving the backlight unit.

Exemplary embodiments of the present invention provide a method for providing an error detection of the backlight unit.

Additional features of the invention will be set forth in the description which follows, and in part will be apparent from the description, or may be learned by practice of the invention.

Exemplary embodiments of the present invention disclose a backlight unit. The backlight unit includes a driving circuit to output a driving voltage. The backlight unit also includes a plurality of light source strings comprising a plurality of light sources disposed to generate a light by driving voltage via an input terminal. The backlight unit includes an error detector coupled to an output terminal of the respective light source strings to receive voltages between the input terminal and the output terminal of the respective light source strings and to detect an error of the light sources by using a first voltage and a second voltage, the first voltage corresponding to a voltage difference between a maximum voltage and a minimum of the received voltages and the second voltage obtained by dividing one of the received voltages by a number of the light sources of a light source string.

Exemplary embodiments of the present invention disclose a method for driving a backlight unit. The method includes receiving voltages between input terminals and output terminals of a plurality of light source strings, each of the light source strings comprising a plurality of light sources. The method also includes detecting an error in the light sources by using a first voltage and a second voltage to output an error detection signal, the first voltage corresponding to a voltage difference between a maximum voltage and a minimum voltage of the received voltages and the second voltage obtained by dividing one received voltage of the received voltages by a number of the light sources of a light source string. The method also includes controlling the driving voltage in response to the error detection signal.

Exemplary embodiments of the present invention disclose a method for providing an error detection of a backlight unit. The method includes receiving voltages between input terminals and output terminals of a plurality of light source strings, each of the light source strings comprising a plurality of light sources. The method also includes detecting an error in the is light sources by using a first voltage and a second voltage, the first voltage corresponding to a voltage difference between a maximum voltage and a minimum voltage of the received voltages and the second voltage obtained by dividing one of the received voltages by a number of the light sources of a light source string.

Exemplary embodiments of the present invention disclose a method. The method includes receiving voltages specifying a voltage with respect to an input and output of a plurality of light sources. The method also includes determining a first voltage and a second voltage, the first voltage corresponding to voltage difference of a maximum voltage and a minimum voltage of received voltages, the second voltage obtained by dividing the received voltages by a number of the plurality of the light sources. The method further includes applying the determined first voltage and the second voltage to monitor an error of the plurality of the light sources.

Exemplary embodiments of the present invention disclose an apparatus. The apparatus includes a logic coupled to a processor of an error detector to determine an error of a plurality of light sources by using a first voltage and a second voltage. The first voltage corresponds to voltage difference of a maximum voltage and a minimum voltage of voltages received, and the second voltage is obtained by dividing the received voltages by a number of the plurality of the light sources. The received voltages specify a voltage with respect to an input and an output of the plurality of light sources.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
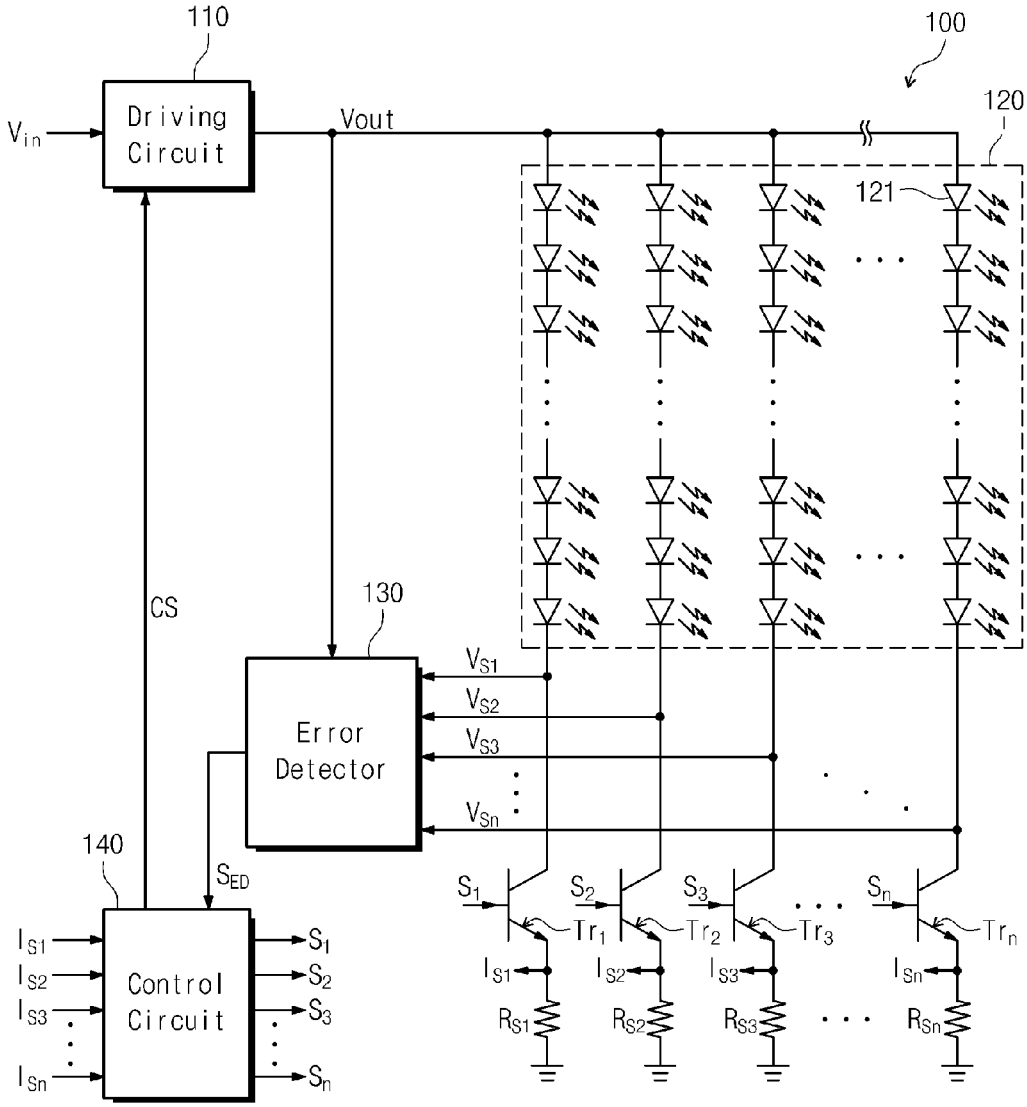
FIG. 1 is a block diagram illustrating a backlight unit according to exemplary embodiments of the present invention.

Advantages and features of the present invention can be understood more readily by reference to the following detailed description of exemplary embodiments and the accompanying drawings. The present invention may, however, be embodied in many different forms and should not be construed as limited to the embodiments set forth herein. Rather, these embodiments are provided so that disclosure is thorough, and will fully convey the scope of the invention to those skilled in the art. In the drawings, the size and relative sizes of layers and regions may be exaggerated for clarity. Like reference numerals in the drawings denote like elements.

It is understood that when an element or a layer is referred to as being "on" "coupled" or "connected to" another element or layer, it can be directly on or directly connected to the other element or layer or intervening elements or layers may be present. In contrast, when an element is referred to as being "directly on" "directly coupled" or "directly connected to" is another element or layer, there are no intervening elements or layers present.

Hereinafter, the present invention will be explained in detail with reference to the accompanying drawings.

FIG. 1 is a block diagram illustrating a backlight unit 100 according to exemplary embodiments of the present invention.

Referring to FIG. 1, the backlight unit 100 may include a driving circuit 110, a plurality of light source strings 120, an error detector 130, and a control circuit 140.

The light source strings 120 can be connected to each other in parallel and each of the light source strings 120 may include a plurality of light sources 121, for example, light emitting diodes (LED), which may be connected to each other in series. The light source strings 120 may include a plurality of zener diodes (not shown) and each of the light sources 121 may be connected to at least one of the zener diodes in parallel.

The driving circuit 110 may receive an input voltage $V_{in}$, for example, about 12 volts, from an outside to output a driving voltage $V_{out}$. An output terminal of the driving circuit 110 may commonly be connected to input terminals of the light source strings 120. Therefore, each of the light source strings 120 may receive the driving voltage $V_{out}$.

Although not shown in FIG. 1, the driving circuit 110 may be a direct current to direct current converter (hereinafter, referred to as DC-DC converter). The driving voltage $V_{out}$ may be used to drive the light sources 121 of the light source strings 120 and may have a voltage level of about 20 volts to about 35 volts. The voltage level of the driving voltage $V_{out}$ may depend on the number of the light sources 121 included in one light source string.

The error detector 130 may be connected to the output terminal of the driving circuit 110 and output terminals of the light source strings 120 to detect a voltage between the is output terminal of the driving circuit 110 and each output terminal of the light source strings 120.

The error detector 130 can detect an error in the light sources 121 by using a first voltage and a second voltage. The first voltage may be a voltage difference between the maximum and the minimum of the detected voltages and the second voltage may be a detected voltage of the detected voltages, which is obtained by dividing the one detected voltage by the number of the light sources 121 included in the light source string from which the one detected voltage can be detected. In this example, the detected voltage may be the maximum voltage of the detected voltages, but may not be limited thereto.

The error detector 130 may electrically be connected to the control circuit 140 and may output an error detection signal $S_{ED}$ to the control circuit 140 if the first voltage is higher than the second voltage. Alternatively, the error detector 130 may output the error detection signal $S_{ED}$ to the control circuit 140 if the first voltage is higher than the second voltage to which a predetermined voltage is added.

The predetermined voltage may be determined by experimentations and existing theories with respect to characteristic of the light sources 121. According to exemplary embodiments of the present invention, the relation between the first voltage and the second voltage to output the error detection signal $S_{ED}$ may be, but not restricted to, an inequation that contains more than one degree variables, for example, the first voltage and the second voltage can be the variables such as an exponential function variable, or a logarithm function variable.

The control circuit 140 may be provided in a chip and may be coupled to the error detector 130 and the driving circuit 110. The control circuit 140 may receive the error detection signal $S_{ED}$ and output a power control signal CS to the driving circuit 110 in response to the error detection signal $S_{ED}$ to control the driving voltage $V_{out}$. For example, the control circuit 140 may is output a power control signal CS to make the driving voltage $V_{out}$ in lower level or block the output of the driving voltage $V_{out}$ if the error detection signal $S_{ED}$ is detected higher than a reference value.

In FIG. 1, the control circuit 140 and the error detector 130 can be seen separately, but according to exemplary embodiments, the control circuit 140 may include the error detector 130.

In some example, the backlight unit 100 may include a plurality of current control devices $Tr_1$~$Tr_n$, and first electrodes of the current control devices $Tr_1$~$Tr_n$ may electrically be coupled to the output terminals of the light source strings 120, respectively. The control circuit 140 may be coupled to second electrodes and third electrodes of the current control devices $Tr_1$~$Tr_n$. The control circuit 140 can detect currents of the light source strings 120 from the third electrodes of the current control devices $Tr_1$~$Tr_n$ and can output current control signals $S_1$~$S_n$ to the second electrodes of the current control devices $Tr_1$~$Tr_n$ in response to receipt of the detected current values $I_{s1}$~$I_{sn}$ and the error detection signal $S_{ED}$ to control currents flowing through the light source strings 120.

In some examples, the control circuit 140 may not be coupled to the third electrodes of the current control devices $Tr_1$~$Tr_n$. In this example, the control circuit 140 may output the current control signals $S_1$~$S_n$ that control currents flowing through the light source strings 120 to the second electrodes of the current control devices $Tr_1$~$Tr_n$ in response to receipt of the error detection signal $S_{ED}$. The error detection signal $S_{ED}$ may include a signal that indicates the existence of errors and a signal that indicates voltages of the light source strings 120.

In some examples, the control circuit 140 may directly be coupled to the output is terminals of the light source strings 120 to detect the voltages and the currents of the light source strings 120 and may output the current control signals $S_1$~$S_n$ according to the detected result.

The backlight unit 100 may include a plurality of resistors $R_{s1}$~$R_{Sn}$ each of which may be coupled between one of the third electrodes of the current control devices $Tr_1$~$Tr_n$ and ground.

Figure 2:
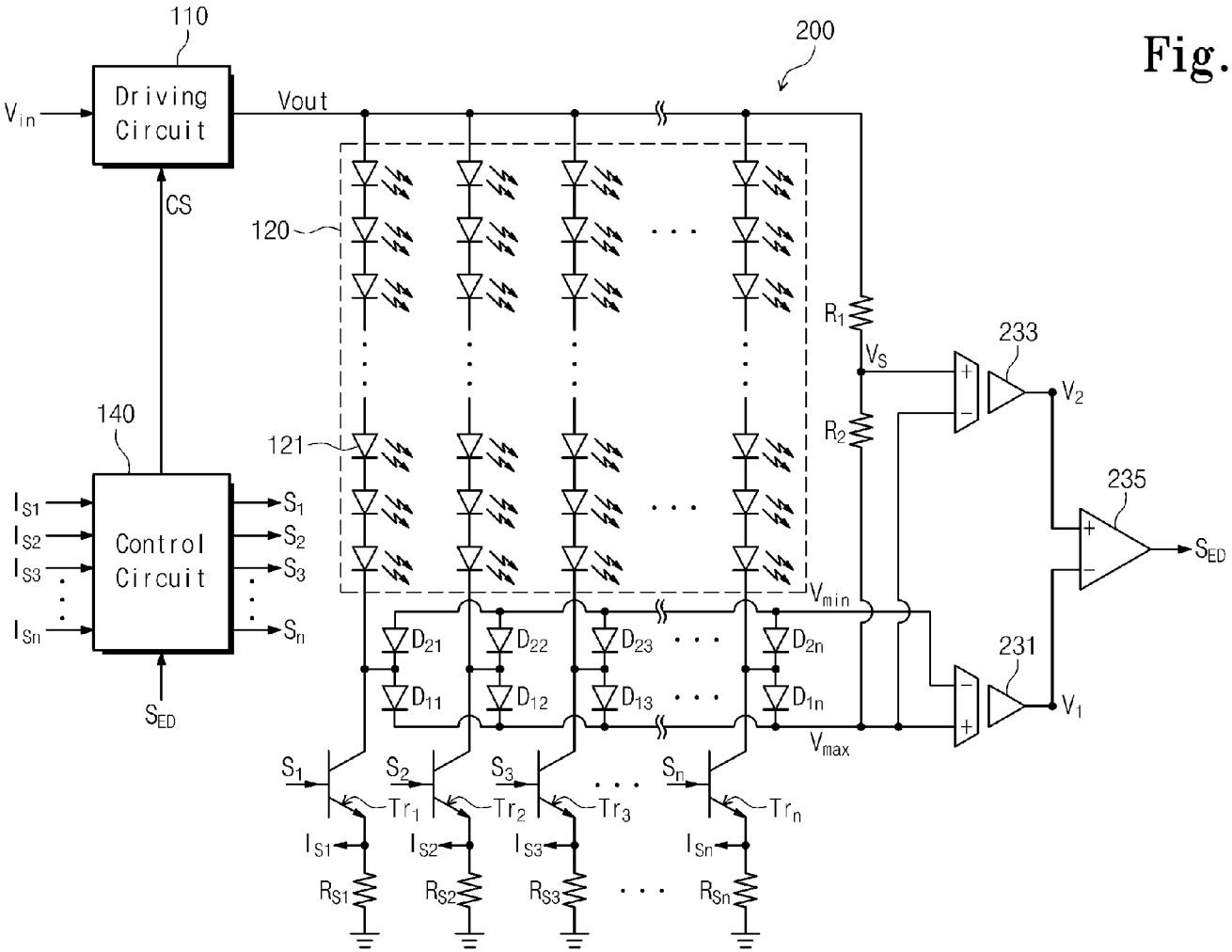
FIG. 2 is a block diagram illustrating a backlight unit according to exemplary embodiments of the present invention.

FIG. 2 is a block diagram illustrating a backlight unit 200 according to exemplary embodiments of the present invention. In FIG. 2, the same reference numerals may denote the same elements in FIG. 1, and thus detailed descriptions of the same elements may be omitted in order to avoid unnecessarily obscuring the invention.

The backlight unit 200 may include the driving circuit 110, the light source strings 120, the control circuit 140, a plurality of first diodes $D_{11}$~$D_{1n}$, a plurality of second diodes $D_{21}$~$D_{2n}$, a first resistor $R_1$, a second resistor $R_2$, a first circuit 231, a second circuit 233, and a comparison circuit 235.

Anode terminals of the first diodes $D_{11}$~$D_{1n}$ may be coupled to the output terminals of the light source strings 120, respectively. In this example, the maximum voltage $V_{max}$ of the light source strings 120 can be output through the cathode terminals of the first diodes $D_{11}$~$D_{1n}$.

Cathode terminals of the second diodes $D_{21}$~$D_{2n}$ may be coupled to the output terminals of the light source strings 120, respectively. In this example, the minimum voltage $V_{min}$ of the light source strings 120 can be output through the anode terminals of the second diodes $D_{21}$~$D_{2n}$.

A terminal of the first resistor $R_1$ may be coupled to the input terminals of the light source strings 120.

The second resistor $R_2$ may be coupled between the first resistor $R_1$ and the cathode terminals of the first diodes $D_{11}$~$D_{1n}$.

According to the configuration of the second circuit 233, resistances of the first resistor $R_1$ and the second resistor $R_2$ can be selected to allow the second circuit 233 to output a second voltage $V_2$ that is obtained by dividing the maximum voltage $V_{max}$ by the number of the light sources 121 of a light source string from which the maximum voltage $V_{max}$ is detected. Preferably, the resistances of the first resistor $R_1$ and the second resistor $R_2$ may be much higher than the resistance of each of the light source strings 120, thereby minimizing currents flowing through the first resistor $R_1$ and the second resistor $R_2$.

A first terminal of the first circuit 231 may be coupled to the cathode terminals of the first diodes $D_{11}$~$D_{1n}$ and a second terminal of the first circuit 231 may be coupled to the anode terminals of the second diodes $D_{21}$~$D_{2n}$. The first circuit 231 can receive the maximum voltage $V_{max}$ and the minimum voltage $V_{min}$ respectively via the first terminal and the second terminal to output a first voltage $V_1$ corresponding to a voltage difference between the maximum voltage $V_{max}$ and the minimum voltage $V_{min}$.

A first terminal of the second circuit 233 may be coupled to the cathode terminals of the first diodes $D_{11}$~$D_{1n}$ and a second terminal of the second circuit 233 may be coupled to a node at which the first resistor $R_1$ and the second resistor $R_2$ are coupled to each other. The second circuit 233 may receive the maximum voltage $V_{max}$ and a division voltage of the node at which the first resistor $R_1$ and the second resistor $R_2$ are coupled to each other through the first terminal and the second terminal, respectively, to output the second voltage $V_2$ that is obtained by dividing the maximum voltage $V_{max}$ by the number of the light sources 121 of a light source string from which the maximum voltage $V_{max}$ is detected.

A terminal of the comparison circuit 235 may be coupled to the output terminal of the first circuit 231 and another terminal of the comparison circuit 235 may be coupled to the output terminal of the second circuit 233. The comparison circuit 235 can receive the first voltage $V_1$ and the second voltage $V_2$ and can compare the first voltage $V_1$ and the second voltage and $V_2$ to detect an error in the light sources 121. The comparison circuit 235 may be a circuit, for example, a differential amplifier, which is capable of comparing two voltages, or a circuit similar to the first circuit 231 or the second circuit 233.

The comparison circuit 235 may output an error detection signal $S_{ED}$ to the control circuit 140 if the first voltage $V_1$ is higher than that of the second voltage $V_2$. The control circuit 140, which may be coupled to the comparison circuit 235 to receive the error detection signal $S_{ED}$, outputs a power control signal CS to the driving circuit 110 in response to receipt of the error detection signal $S_{ED}$ to control the driving voltage $V_{out}$. Also, the control circuit 140 may output current control signals $S_1$~$S_n$ to the current control devices $Tr_1$~$Tr_n$ to control currents flowing through the light source strings 120.

In some examples, the comparison circuit 235 may output the error detection signal $S_{ED}$ to the control circuit 140 if the first voltage $V_1$ is has higher than the second voltage $V_2$ to which a predetermined voltage is added. The control circuit 140 may be coupled to the comparison circuit 235 to receive the error detection signal $S_{ED}$ and to output the power control signal CS to the driving circuit 110 in response to receipt of the error detection signal $S_{ED}$ that controls the driving voltage $V_{out}$. Also, the control circuit 140 may output the current control signal $S_1$~$S_n$ to the current control devices $Tr_1$~$Tr_n$ to control currents flowing through the light source strings 120.

Although not shown in FIG. 2, the first terminal of the second circuit 233 may is alternately be coupled to the anode terminals of the second diodes $D_{21}$~$D_{2n}$. Also, the second resistor $R_2$ may alternately be coupled between the first resistor $R_1$ and the anode terminals of the second diodes $D_{21}$~$D_{2n}$. In this alternative example, the second circuit 233 can receive the minimum voltage $V_{min}$ to output a second voltage $V_2$ that is obtained by dividing the minimum voltage $V_{min}$ by the number of the light sources 121 of a light source string from which the minimum voltage $V_{min}$ is detected.

In some examples, the relation between the first voltage $V_1$ and the second voltage $V_2$ to output the error detection signal $S_{ED}$ may be, but not restricted to, an inequation that contains more than one degree variables, for example, the first voltage and the second voltage can be the variables such as an exponential function variable, or a logarithm function variable.

Figure 3:
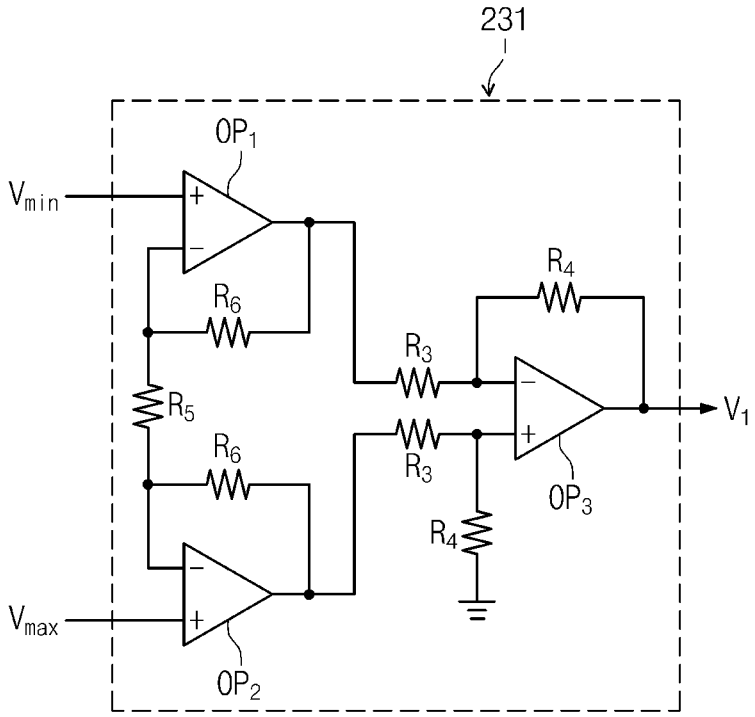
FIG. 3 is a circuit diagram illustrating a first circuit of FIG. 2.

FIG. 3 is a circuit diagram illustrating a first circuit 231 of FIG. 2. The first circuit illustrated in FIG. 3 may be an example and may be any circuit known as differential amplifiers can be used.

The first circuit 231 may include a first operational amplifier (hereinafter referred to as 'OP amplifier') $OP_1$, a second OP amplifier $OP_2$, a third OP amplifier $OP_3$, two third resistors $R_3$, two fourth resistors $R_4$, a fifth resistor $R_5$, and two sixth resistors $R_6$.

A positive (+) terminal of the first OP amplifier $OP_1$ may be coupled to the anode terminals of the second diodes $D_{21}$~$D_{2n}$ to receive the minimum voltage $V_{min}$ and a positive terminal of the second OP amplifier $OP_2$ may be coupled to the cathode terminals of the first diodes $D_{11}$~$D_{1n}$ to receive the maximum voltage $V_{max}$.

The fifth resistor $R_5$ may be coupled between a negative (−) terminal of the first OP amplifier $OP_1$ and a negative terminal of the second OP amplifier $OP_2$.

One of the sixth resistors $R_6$ may be connected between the negative terminal and is an output terminal of the first OP amplifier $OP_1$ and the other of the sixth resistors $R_6$ may be connected between the negative terminal and an output terminal of the second OP amplifier $OP_2$.

One of the third resistor $R_3$ my be coupled between the output terminal of the first OP amplifier $OP_1$ and a negative terminal of the third OP amplifier $OP_3$ and the other of the third resistor $R_3$ may be coupled between the output terminal of the second OP amplifier $OP_2$ and a positive terminal of the third OP amplifier $OP_3$.

One of the fourth resistors $R_4$ may be coupled between the positive terminal of the third OP amplifier $OP_3$ and ground, and the other of the fourth resistor $R_4$ may be coupled between an output terminal and the negative terminal of the third OP amplifier $OP_3$.

The relation between the first voltage $V_1$ output from the first circuit 231 and the minimum and maximum voltages $V_{min}$ and $V_{max}$ input to the first circuit 231 can satisfy Equation 1 below.

$$V1 = \frac{R_4\left(1 + \frac{R_4}{R_3}\right)(V_{max} - V_{min})}{R_3} \quad \text{Equation 1}$$

In this example, resistances of the third resistor R3 and fourth resistor R4 can be selected to satisfy Equation 2 below.

$$\frac{R_4\left(1 + \frac{R_4}{R_3}\right)}{R_3} = 1 \quad \text{Equation 2}$$

Although not shown in figures, the second circuit 233 of FIG. 2 may be a circuit that is similar to the first circuit 231 of FIG. 3 or a different circuit having the same function.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A backlight unit, comprising:

a driving circuit to output a driving voltage;

a plurality of light source strings comprising a plurality of light sources disposed to generate a light in response to a driving voltage received via an input terminal of the respective light source strings; and an error detector coupled to an output terminal of the respective light source strings to receive voltages between the input terminal and the output terminal of the respective light source strings and to detect an error of the light sources by using a first voltage and a second voltage, the first voltage corresponding to a voltage difference between a maximum voltage and a minimum voltage of the received voltages and the second voltage obtained by dividing one of the received voltages by a number of the light sources of a light source string.

2. The backlight unit of claim 1, wherein the one of the received voltages comprises the maximum voltage.

3. The backlight unit of claim 2, further comprising:

a plurality of current control devices each comprising a first electrode coupled to the respective output terminals of the light source strings; and a control circuit coupled to a second electrode of each current control device, the driving circuit, and the error detector.

4. The backlight unit of claim 3, wherein the error detector outputs an error detection signal to the control circuit if a level of the first voltage is higher than a level of the second voltage.

5. The backlight unit of claim 4, wherein the control circuit outputs a power control signal to the driving circuit in response to receipt of the error detection signal to control the driving voltage.

6. The backlight unit of claim 4, wherein the control circuit outputs a current control signal to the current control devices in response to receipt of the error detection signal to control currents flowing through the light source strings.

7. The backlight unit of claim 3, wherein the error detector outputs an error detection signal to the control circuit if a level of the first voltage is higher than a level of a third voltage, the third voltage being a sum of the second voltage and a predetermined voltage.

8. The backlight unit of claim 7, wherein the control circuit outputs a power control signal to the driving circuit in response to receipt of the error detection signal to control the driving voltage.

9. The backlight unit of claim 7, wherein the control circuit outputs a current control signal to the current control devices in response to receipt of the error detection signal to control currents flowing through the light source strings.

10. A method for driving a backlight unit, the method comprising:

receiving voltages between input terminals and output terminals of a plurality of light source strings, each of the light source strings comprising a plurality of light sources;

detecting an error in the light sources by using a first voltage and a second voltage to output an error detection signal, the first voltage corresponding to a voltage difference between a maximum voltage and a minimum voltage of the received voltages and the second voltage obtained by dividing one received voltage of the received voltages by a number of the light sources of a light source string; and controlling the driving voltage in response to the error detection signal.

11. The method of claim 10, wherein the one received voltage of the received voltages comprises the maximum voltage of the received voltages.

12. The method of claim 11, wherein the error detection signal is outputted if the first voltage is detected higher than the second voltage.

13. The method of claim 12, further comprising:

controlling currents flowing via the light source strings in response to receipt of the error detection signal.

14. The method of claim 11, wherein the error detection signal is output if the first voltage is detected higher than the second voltage to which a predetermined voltage is added.

15. The method of claim 14, further comprising:

controlling currents flowing via the light source strings in response to receipt of the error detection signal.

16. A backlight unit, comprising:

a driving circuit to output a driving voltage;

a plurality of light source strings coupled to each other in parallel, each of the light source strings comprising a plurality of light sources and to receive the driving voltage via an input terminal of each light source strings to generate a light;

a plurality of first diodes each comprising an anode terminal coupled to a respective output terminals of the light source strings;

a plurality of second diodes each comprising a cathode terminal coupled to the respective output terminals of the light source strings;

a first resistor comprising a first terminal coupled to the input terminal of the light source strings;

a second resistor coupled between a second terminal of the first resistor and cathode terminals of the first diodes;

a first circuit coupled to the cathode terminals of the first diodes and anode terminals of the second diodes to output a first voltage generated between the cathode terminals and the anode terminals;

a second circuit coupled to the cathode terminals of the first diodes and a node at which the first resister and the second resistor are coupled to output a second voltage generated between the cathode terminals and the node; and a comparison circuit coupled to the first circuit and the second circuit to detect an error of the light sources by using the first voltage and the second voltage.

17. The backlight unit of claim 16, further comprising:

a plurality of current control devices each comprising a first electrode coupled to the respective output terminals of the light source strings; and a control circuit coupled to a second electrode of each current control devices, the driving circuit, and the error detector.

18. The backlight unit of claim 17, wherein the comparison circuit outputs an error detection signal to the control circuit if the first voltage is detected higher than the second voltage and the control circuit outputs a power control signal to the driving circuit in response to receipt of the error detection signal to control the driving voltage and outputs a current control signal to the current control devices to control currents flowing via the light source strings.

19. The backlight unit of claim 17, wherein the comparison circuit outputs an error detection signal to the control circuit if the first voltage is detected higher than the second voltage to which a predetermined voltage is added and the control circuit outputs a power control signal to the driving circuit in response to receipt of the error detection signal to control the driving voltage and outputs a current control signal to the current control devices to control currents flowing via the light source strings.

20. A method for providing an error detection of a backlight unit, the method comprising:

receiving voltages between input terminals and output terminals of a plurality of light source strings, each of the light source strings comprising a plurality of light sources; and detecting an error in the light sources by using a first voltage and a second voltage, the first voltage corresponding to a voltage difference between a maximum voltage and a minimum voltage of the received voltages and the second voltage obtained by dividing one of the received voltages by a number of the light sources of a light source string.

21. The method of claim 20, wherein the one of the received voltages comprises the maximum voltage.

22. The method of claim 21, wherein detecting the error of the light sources is determined if the first voltage is detected higher than the second voltage.

23. The error detection method of claim 21, wherein detecting the error of the light sources is determined if the first voltage is detected higher than the second voltage which is added by a predetermined voltage.

24. A method, comprising:

receiving voltages specifying a voltage with respect to an input and output of a plurality of light sources;

determining a first voltage and a second voltage, the first voltage corresponding to voltage difference of a maximum voltage and a minimum voltage of received voltages, the second voltage obtained by dividing the received voltages by a number of the plurality of the light sources; and applying the determined first voltage and the second voltage to monitor an error of the plurality of the light sources.

25. An apparatus, comprising:

a logic coupled to a processor of an error detector to determine an error of a plurality of light sources by using a first voltage and a second voltage, the first voltage corresponding to voltage difference of a maximum voltage and a minimum voltage of voltages received, the second voltage obtained by dividing the received voltages by a number of the plurality of the light sources, wherein the received voltages specifying a voltage with respect to an input and an output of the plurality of light sources.

* * * * *